US011603727B1

(12) United States Patent
Munir et al.

(10) Patent No.: US 11,603,727 B1
(45) Date of Patent: Mar. 14, 2023

(54) FLOW ACTIVATED ON-OFF CONTROL SUB FOR PERSEUS CUTTER

(71) Applicants: Waqas Munir, Houston, TX (US); Adam Larsen, Spring, TX (US)

(72) Inventors: Waqas Munir, Houston, TX (US); Adam Larsen, Spring, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/408,187

(22) Filed: Aug. 20, 2021

(51) Int. Cl.
*E21B 29/00* (2006.01)
*E21B 34/08* (2006.01)

(52) U.S. Cl.
CPC ..... *E21B 29/005* (2013.01); *E21B 34/08* (2013.01); *E21B 2200/04* (2020.05)

(58) Field of Classification Search
CPC ..... E21B 29/00; E21B 29/002; E21B 29/005
See application file for complete search history.

(56) References Cited

U.S. PATENT DOCUMENTS 1,998,804 A * 4/1935 Flury ..... E21B 29/005 166/55.7
2,525,007 A * 10/1950 Worden ..... E21B 29/005 166/55.8
2010/0089583 A1* 4/2010 Xu ..... E21B 47/13 175/57
2012/0186816 A1* 7/2012 Dirksen ..... E21B 7/00 166/113
2013/0299169 A1* 11/2013 Rex ..... E21B 43/108 166/285
2014/0096947 A1* 4/2014 Colbert ..... E21B 29/002 166/55.2
2015/0027780 A1* 1/2015 Hern ..... E21B 37/02 175/57
2016/0130897 A1* 5/2016 Machocki ..... E21B 29/00 166/240

* cited by examiner

*Primary Examiner* — David Carroll
(74) *Attorney, Agent, or Firm* — Cantor Colburn LLP

(57) ABSTRACT

A wellbore system includes method of cutting a casing in a wellbore. A string is disposed in the casing, the string including a cutting tool and an activation sub coupled to the cutting tool. The cutting tool includes a ball seat and a cutter. The activation sub includes a control piston disposed therein. The control piston has a ball at an end thereof. The control piston is configured to move within the activation sub to engage the ball to the ball seat when a flow rate of a fluid through the control piston is above a flow rate activation threshold, wherein engaging the ball to the ball seat creates a pressure differential across the ball seat that moves the ball seat to extend the cutter from the cutting tool.

16 Claims, 6 Drawing Sheets

FLOW ACTIVATED ON-OFF CONTROL SUB FOR PERSEUS CUTTER

BACKGROUND

In the resource recovery industry, a cutting tool can be lowered on a string into a casing in a wellbore in order to cut the casing. The cutting tool includes a cutter that can be extended from the tool and withdrawn back into the tool. The cutter is extended by dropping a ball through a bore of the string onto a ball seat coupled to the cutter. This ball drop method requires that there are no tools or obstacles along the length of the string that obstruct the descent of the ball. However, this requirement is restrictive on the design of strings that have cutting tools. Accordingly, there is a need for a more compatible mechanism for seating a ball at a ball seat to extend the cutter.

SUMMARY

In one aspect, a method of cutting a casing in a wellbore is disclosed. A string is disposed in the casing, the string including a cutting tool and an activation sub coupled to the cutting tool, the cutting tool including a ball seat and a cutter, the activation sub including a control piston disposed therein, the control piston having a ball at an end thereof. A fluid is flowed through the activation sub. A flow rate of the fluid is raised to move the control piston to engage the ball on the ball seat, wherein engaging the ball on the ball seat creates a pressure differential across the ball seat that moves the ball seat. The cutter is extended from the cutting tool via movement of the ball seat.

In another aspect, a wellbore system is disclosed The wellbore system includes a cutting tool having a ball seat coupled to a cutter and an activation sub coupled to the cutting tool. The activation sub includes a control piston movable therethrough, the control piston having a ball at an end thereof; wherein the control piston is configured to move within the activation sub to engage the ball to the ball seat when a flow rate of a fluid through the control piston is above a flow rate activation threshold, wherein engaging the ball to the ball seat creates a pressure differential across the ball seat that moves the ball seat to extend the cutter from the cutting tool.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
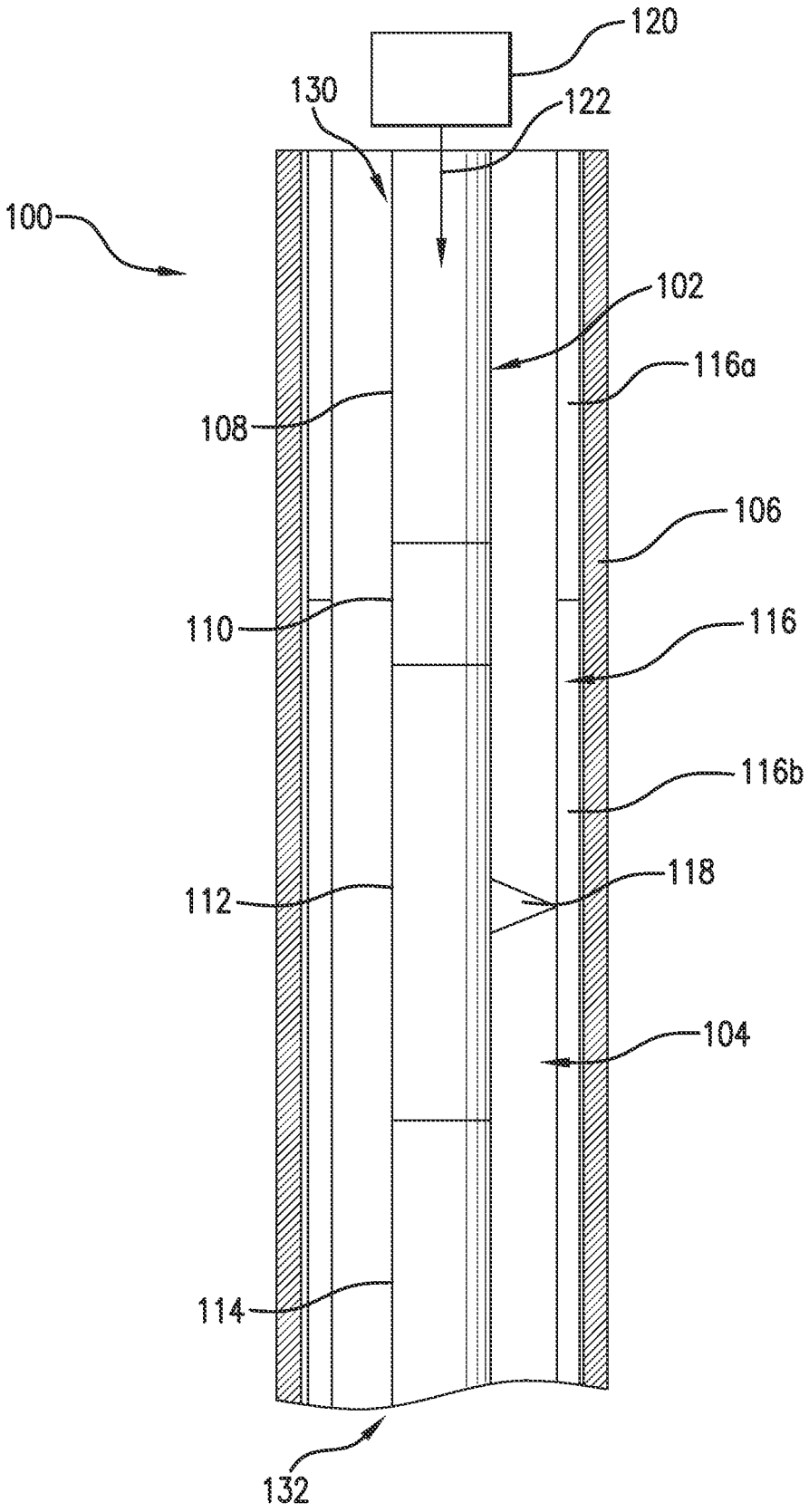
FIG. 1 shows a wellbore system including a string disposed in a wellbore in a formation.

Referring to FIG. 1, a wellbore system 100 is shown including a string 102 disposed in a wellbore 104 in a formation 106. The string 102 extends from a first end 130 to a second end 132 along a longitudinal string axis. In general, the first end 130 is uphole and the second end 132 is downhole when the string 102 is disposed in the wellbore 104. Thus, for items located on the string 102, movement of the item "uphole" refers to a longitudinal movement of the item toward the first end 130 and movement of the item "downhole" refers to a longitudinal movement of the itme towards the second end 132. First end 130 and second end 132 are also shown in FIGS. 2-8 to aid in illustration.

The string 102 includes a top sub 108, activation sub 110 and cutting tool 112, with the activation sub 110 disposed between the top sub 108 and the cutting tool 112. A bottom sub 114 or other subs can be disposed at a bottom or downhole end of the cutting tool 112, in various embodiments. The top sub 108, activation sub 110 and cutting tool 112 are tubular devices, each having a longitudinal axis. When the top sub 108, activation sub 110 and cutting tool 112 are coupled together, their longitudinal axes are substantially coaxial.

The wellbore 104 includes a casing 116 along its inner wall. The casing 116 can include several casing sections that are mated to each other in sequence to form the casing 116, such as first casing section 116*a* and second casing section 116*b*. The string 102 can be moved along the wellbore 104 to place the cutting tool 112 at a selected location within the wellbore 104 and casing 116 . The cutting tool 112 includes a cutter 118 that can be extended from and retracted into the cutting tool 112, using the methods disclosed herein. In its extended state, the cutter 118 contacts the casing 116. When the cutter 118 is extended from the cutting tool 112, the string 102 can be moved longitudinally along the wellbore 104 to allow the cutter 118 to cut the casing 116. A pump 120 circulates a working fluid 122 through the string 102. The pressure and/or flow rate of the working fluid 122 can be controlled at the pump 120 to perform various downhole operations, such as rotating a drilling motor, etc., as a well as to either extend or retract the cutter 118.

The string 102 can be lowered into the wellbore 104 and various operations can be performed using the string 102. The operations include extending the cutter 118 from the cutting tool 112 to engage the casing 116 and moving the cutting tool 112 through the casing 116 to cutting the casing 116. In addition, other operations can be performed downhole that bypass activation of the cutting tool 112 or, in other words, bypass extending the cutter 118 from the cutting tool 112. In an embodiment, the top sub 108 can include at least one of a pulling sub, a we311bore cleaning tool, and a punching sub or perforation device.

The top sub 108 can be run into a well to a location in which the top sub 108 is located in the first casing section 116*a* and the cutting tool 112 is located in a second casing section 116*b*.

The bottom sub 114 can include a drill bit or milling tool. The pulling sub of the top sub 108 can be activated using hydraulic fluid to attach itself or anchor itself to the first casing section 116*a*. The pulling tool can then he activated to pull the cutting tool 112 through the second casing section 116*b* to cutting the first casing section 116*a*. The pulling tool can be activated without extending the cutter 118 from the cutting tool 112. Other downhole procedures that can also be performed without extending the cutter 118 from the cutting tool 112 include cleaning and dressing a casing using a cleaning tool, perforating the casing using the punching sub/perforation device, etc.

Figure 2:
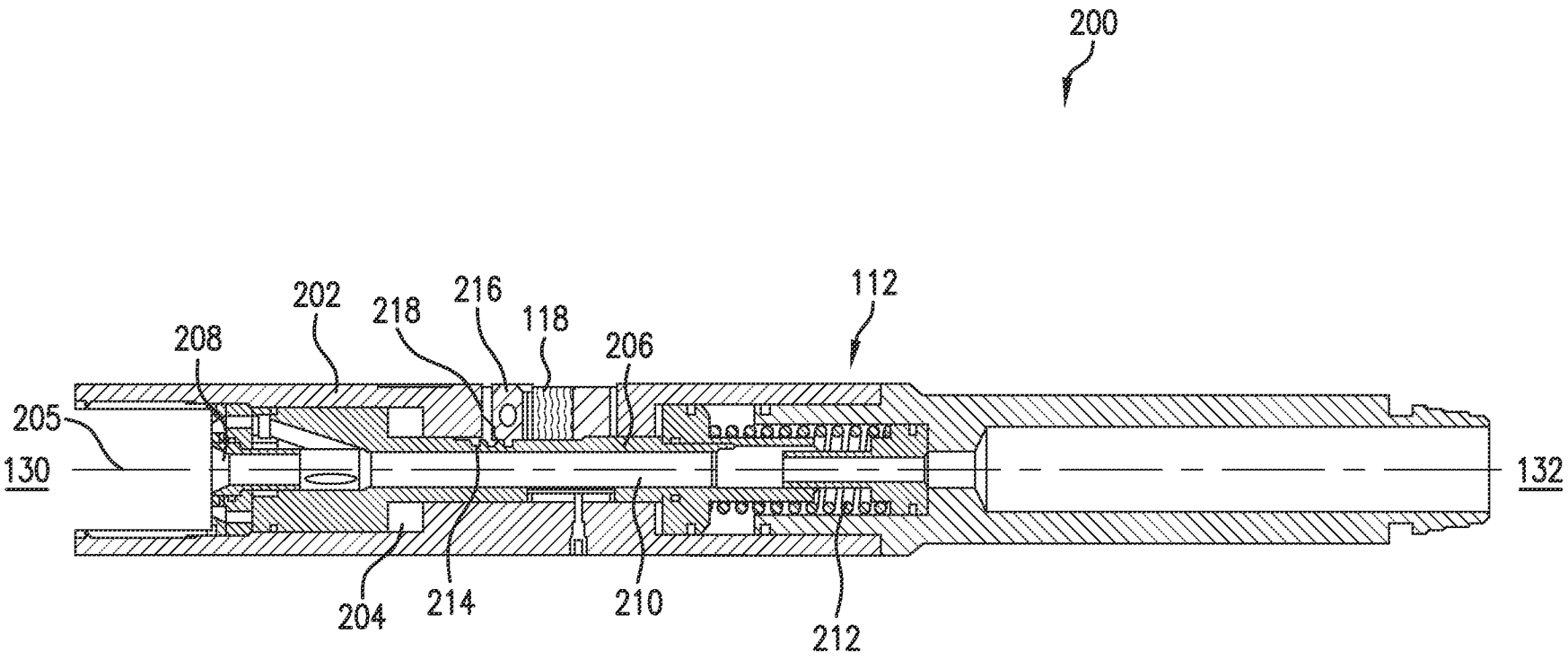
FIG. 2 shows sectional view of a tool of the string, in an illustrative embodiment.

FIG. 2 shows a cross-sectional view 200 of the cutting tool 112 of the string 102, in an illustrative embodiment. The cutting tool 112 includes a housing 202 having a tool bore 204 extending therethrough. A cutter piston 206 is disposed in the tool bore 204 and is movable within the tool bore 204 along a longitudinal axis 205 of the cutting tool 112. The cutter piston 206 includes a ball seat 208 at an uphole end for receiving a ball. A piston bore 210 extends through the cutter piston 206 along the longitudinal axis 205 to allow fluid to flow through the cutter piston 206. A biasing device such as a spring 212 applies a biasing force against the cutter piston 206 toward the first end 130 to maintain the cutter piston 206 in a first position or cutter-deactivated position.

A ball can be seated at the ball seat 208 to control the position of the cutter piston 206. When a ball is not seated at the ball seat 208, a fluid can flow through the ball seat 208 and the piston bore 210, allowing the cutter piston 206 to remain in the first position. When a ball is seated at the ball seat 208, fluid is prevented from flowing through the piston bore 210, thereby building a fluid pressure differential at the ball seat 208. A sufficient downward force caused by the fluid pressure differential at the ball seat 208 overcomes the biasing force of spring 212 to move the cutter piston 206 along the tool bore 204 to place the cutter piston 206 in a second position (i.e., a cutter-activated position) toward the second end 132.

The cutter piston 206 includes a series of recesses or notches 214 longitudinally spaced apart along its outer diameter surface. A gear 216 is rotationally coupled to the housing 202 and includes teeth 218 that engage the notches 214, allowing the gear 216 to rotate as the cutter piston 206 moves longitudinally. The gear 216 is coupled to the cutter 118. With the cutter piston 206 in the first position, the cutter 118 is retracted into the housing 202 of the cutting tool 112. As the cutter piston 206 moves into the second position, the cutter piston 206 rotates the gear 216 to extend the cutter 118 from the housing 202. As the cutter piston 206 moves back to the first position, the cutter piston 206 counter-rotates the gear 216 to retract the cutter 118 into the housing 202.

Figure 3:
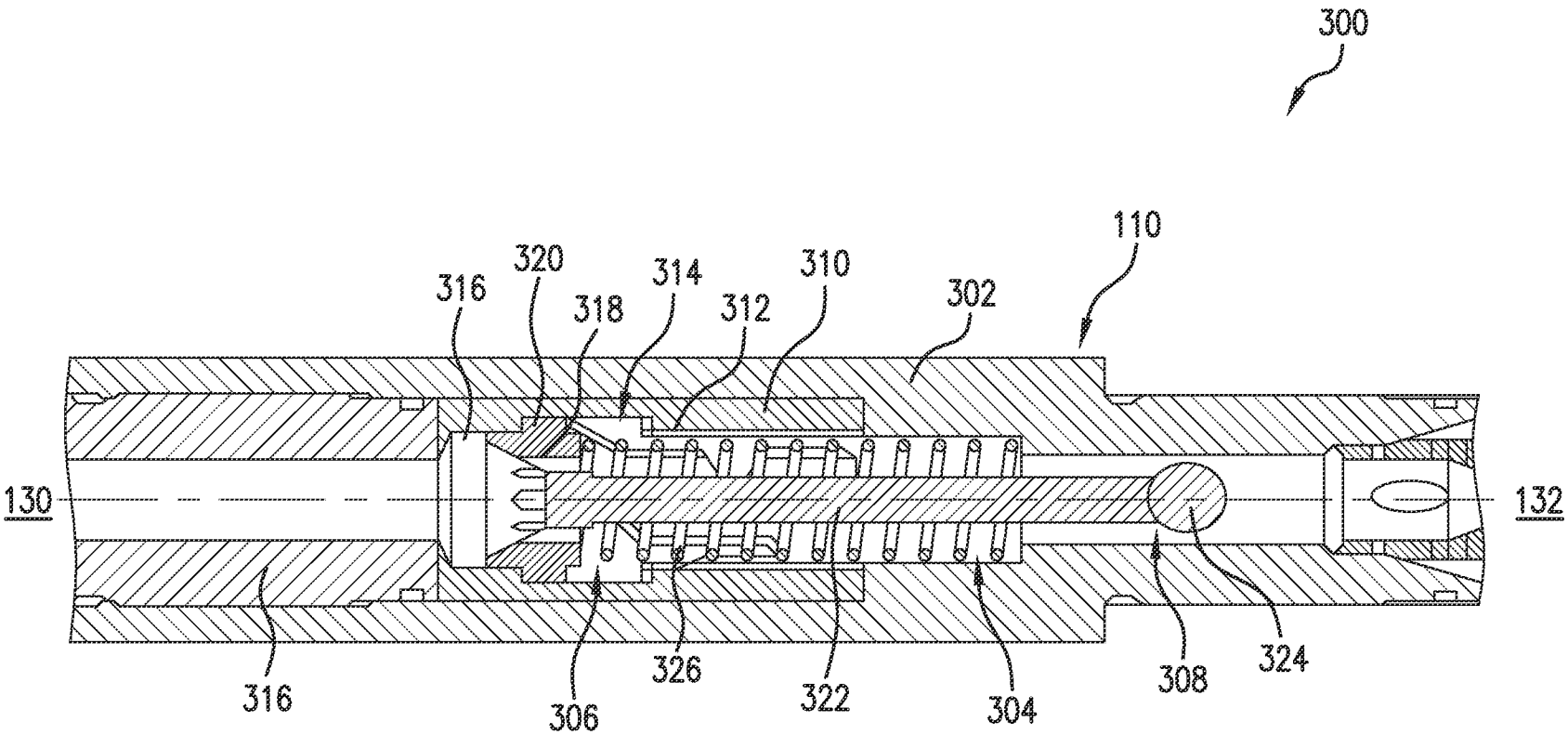
FIG. 3 shows a cross-sectional view of an activation sub of the string, in an illustrative embodiment.

FIG. 3 shows a cross-sectional view 300 of the activation sub 110 of the string 102 in an illustrative embodiment. The activation sub 110 includes a sleeve housing 302 having a sub bore 304 therethrough. The sub bore 304 includes a first section 306 and a second section 308 extending from the first section 306 towards the second end 132.

A sleeve 310 is disposed within the first section 306 and is able to slide longitudinally within the first section 306 and to rotate about the longitudinal axis 205 within the first section 306. Sleeve 310 is configured to the first section 306. The sleeve 310 includes a sleeve bore therethrough. An inner diameter wall 312 of the sleeve 310 includes a grooved pattern or a groove 314 forming a recessed track into the inner diameter wall 312 of the sleeve 310. In various embodiments, the groove 314 form a track that includes paths for rotating the sleeve when a non-rotating pin moves through the track.

A control piston 316 is disposed within the sleeve 310 and is slidable within the sleeve 310 along the longitudinal axis 205. A control spring 326 or other suitable biasing device is located within the first section 306. The control spring 326 applies a biasing force on the control piston 316 to hold the control piston 316 in a first control position (i.e., a flow-deactivated position) near the first end 130.

The control piston 316 includes a nozzle 318 or interior fluid passages that allow fluid to pass through the control piston 316 and thereby through the sleeve 310. The rate of fluid flowing through the nozzle 318 applying a downhole force which, in combination with the uphole force of the control spring 326, controls the position of the control piston 316. The nozzle 318 can include a plurality of nozzles, in various embodiments. When fluid is flowing through the control piston 316 at a first rate below a flow rate activation threshold, the force of the control spring 326 maintains the control piston 316 in the first control position. When the fluid is flowing through the control piston 316 at a flow rate that is above the flow rate activation threshold, a sufficient downhole force is applied on the control piston 316 to overcome the biasing force of the control spring 326, thereby moving the control piston 316 to a second control position (i.e., a flow-activated position).

An activation dart 322 extends from the control piston 316 toward the second end 132 along the longitudinal axis 205. The activation dart 322 extends through the control spring 326 into the second section 308. The activation dart 322 has a head 324 (also referred to herein as a "ball") at and end distal from the control piston 316. The head 324 is in the shape of a ball that has dimensions allowing it to sit within the ball seat 208. When the control piston 316 is in the first position, the head 324 is separated from the ball seat 208 by a gap, thereby allowing fluid to flow through the piston bore 210. When the control piston 316 is in the second position, the head 324 is seated at or engaged to the ball seat 208, thereby blocking flow of fluid through the piston bore 210 and creates a pressure differential across the ball seat 208.

The control piston 316 includes a pin 320 extending radially outward from its outer diameter surface. The control piston 316 is arranged within the sleeve 310 so that the pin 320 resides within the groove 314 of the inner diameter wall 312. As the control piston 316 moves back and forth along the longitudinal axis 205, the pin 320 moves through the groove 314 and causes the sleeve 310 to rotate within the first section 306, as discussed below with respect to FIGS. 4-7.

Figure 4:
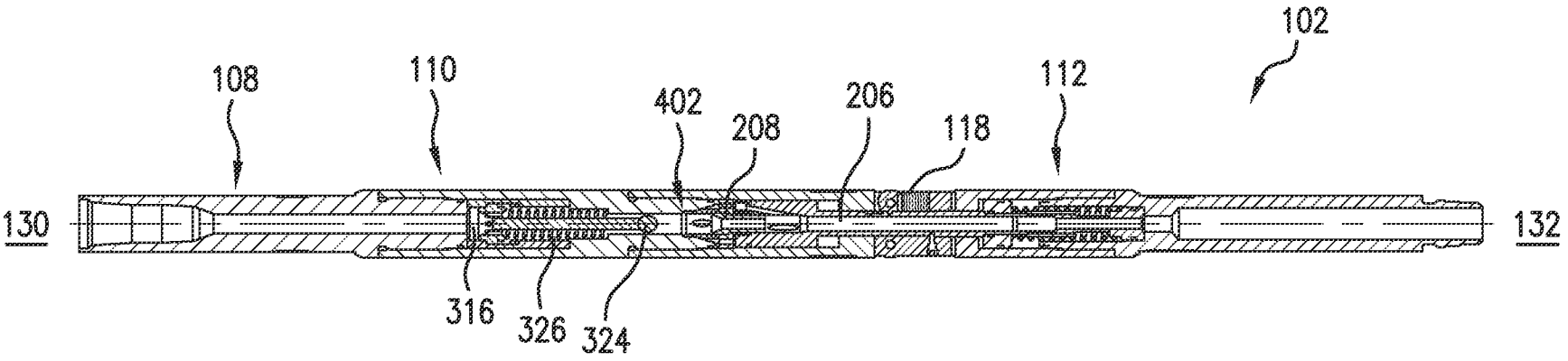
FIG. 4 shows a view of the string in a first state.

FIGS. 4-7 shows cross-sectional views of the string 102 in various states based on different flow rates of fluid within the string 102. FIG. 4 shows a view 400 of the string 102 in a first state. The string 102 includes the top sub 108, activation sub 110 and cutting tool 112 coupled together so that the bores of the top sub 108, activation sub 110 and cutting tool 112 are substantially coaxial. In the first state, fluid is not flowing through the string 102. Thus, the control piston 316 is biased into the first position via the control spring 326, thereby maintaining a gap 402 between the head 324 and the ball seat 208. Consequently, the cutter piston 206 is maintained in the first position by the spring 212 and the cutting tool 112 is deactivated (i.e., the cutter 118 is retracted into the housing 202).

Figure 5:
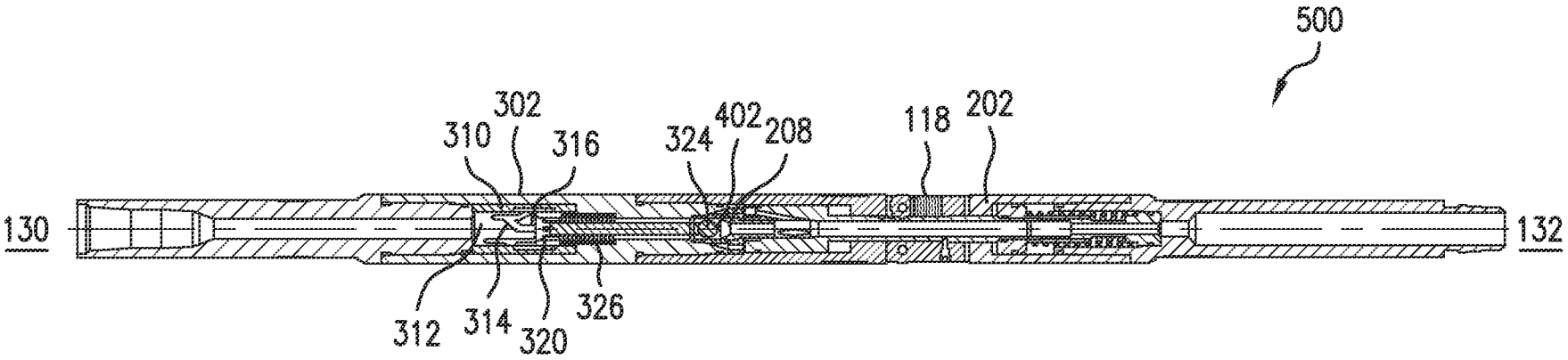
FIG. 5 shows the string in a second state in which fluid flows through the string to perform downhole operations.

FIG. 5 shows the string 102 in a second state in which fluid flows through the string 102 to perform downhole operations. The fluid flows the string 102 at a flow rate below an activation threshold. Therefore, under pressure of the fluid. the control piston 316 moves downhole but does not seat the head 324 at the ball seat 208, but rather the gap 402 remains between them. Since the head 324 does not sit on the ball seat 208, fluid flows through the piston bore 210 without moving the cutter piston 206 and the cutter 118 remains retracted in the housing 202.

The control piston 316 moves the pin 320 longitudinally to interact with the groove 314. Since the pin 320 does not rotate, the sleeve 310 rotates within the sleeve housing 302 as the pin 320 moves through the groove 314. In various embodiments, the sleeve 310 rotates by a quarter turn or quarter revolution from its rotational position in the first state.

Figure 6:
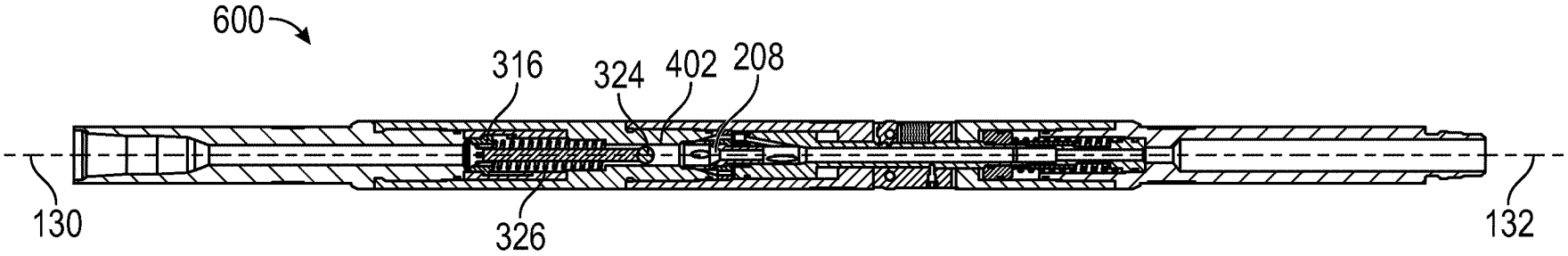
FIG. 6 shows the string in a third state in which fluid flow through the string has been stopped.

FIG. 6 shows the string 102 in a third state in which fluid flow through the string 102 has been stopped. The control piston 316 returns back to the first control position due to the biasing force of the control spring 326. As the control piston 316 moves back to the first control position, the pin 320 moves through the groove 314 of the sleeve 310 to rotate the sleeve 310 another quarter turn.

Figure 7:
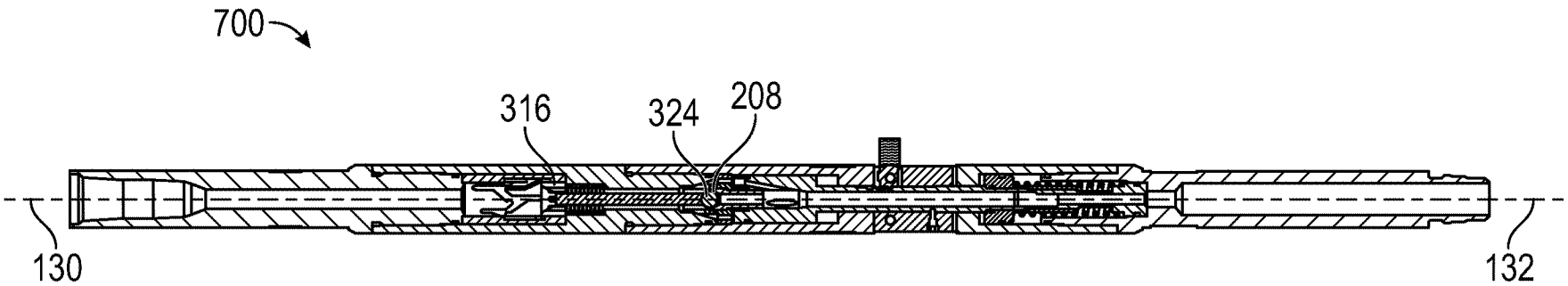
FIG. 7 shows the string in a fourth state in which fluid flows through the string at a flow rate above the activation threshold.

FIG. 7 shows the string 102 in a fourth state in which fluid flows through the string 102 at a flow rate above the activation threshold. At this flow rate, the control piston 316 moves longitudinally to seat the head 324 in the ball seat 208. With the head 324 seated at the ball seat 208, a fluid pressure differential is created across the ball seat 208 that applies a force against the force of the spring 212 to move the cutter piston 206 into the second position, thereby extending the cutter 118 from the housing 202. In the process, the pin 320 moves through the groove 314 to rotate the sleeve 310 another quarter turn.

From the fourth state, once the fluid flow is stopped, the control piston 316 returns to its first position to remove the head 324 from the ball seat 208. With the pressure differential at the ball seat 208 removed, the cutter piston 206 returns to its first position, thereby retracting the cutter 118 into the housing 202. The sleeve 310 performs another quarter turn, completing a full revolution to arrive at its position in the first state shown in FIG. 4.

Thus, the four stages shown in FIG. 4 allow the fluid to flow through the string 102 to perform non-cutting operations (i.e., the second state). A subsequent flow of fluid through the string 102 can be used to extend the cutter 118 from the cutting tool 112 (i.e., the fourth state) to cut the casing 116. After cutting the casing 116, fluid can flow through the string 102 again to perform other non-cutting operations.

Figure 8:
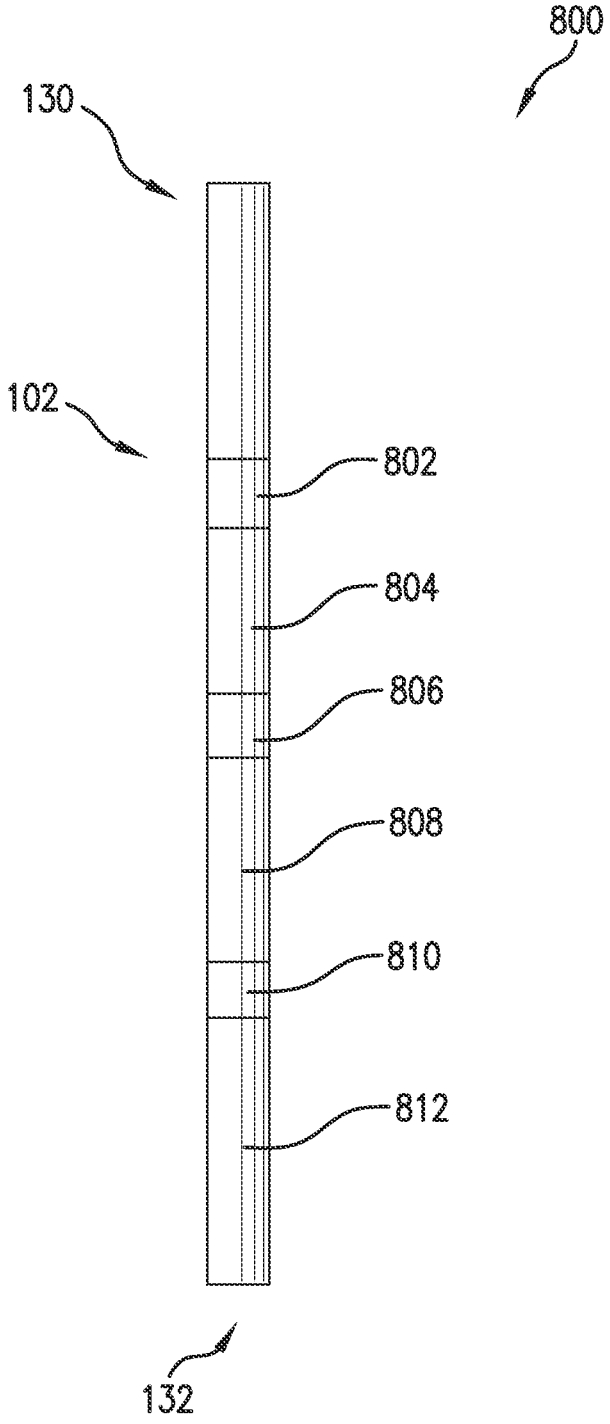
FIG. 8 shows the string in an alternate embodiment including a plurality of cutting tools and activation subs.

FIG. 8 shows the string 102 in an alternate embodiment including a plurality of cutting tools and activation subs. The string 102 includes a first activation sub 802 and first cutting tool 804, a second activation sub 806 and second cutting tool 808, and a third activation sub 810 and third cutting tool 812, in order as one progresses from the first end 130 to the second end 132. The second activation sub 806 operating the second cutting tool 808, while the third activation sub 810 operates the third cutting tool 812. The activation flow rate threshold for the third activation sub 810 is less than the activation flow rate threshold for the second activation sub 806 which is less than the activation flow rate threshold for the first activation sub 802. Although three activation subs and cutting tools are shown in FIG. 8, the relation between their activation thresholds holds for a string 102 having any plurality of activation subs and cutting tools.

Set forth below are some embodiments of the foregoing disclosure:

Embodiment 1. A method of cutting a casing in a wellbore. A string is disposed in the casing, the string including a cutting tool and an activation sub coupled to the cutting tool, the cutting tool including a ball seat and a cutter, the activation sub including a control piston disposed therein, the control piston having a ball at an end thereof. A fluid is flowed through the activation sub. A flow rate of the fluid is raised to move the control piston to engage the ball on the ball seat, wherein engaging the ball on the ball seat creates a pressure differential across the ball seat that moves the ball seat. The cutter is extended from the cutting tool via movement of the ball seat.

Embodiment 2. The method of any prior embodiment, wherein the control piston is biased in a first control position in which the ball is separated from the ball seat by a gap, further comprising flowing the fluid through the control piston above a flow rate activation threshold to move the control piston from the first position to a second position in which the ball is engaged to the seat.

Embodiment 3. The method of any prior embodiment, further comprising engaging a pin of the control piston to a groove of a sleeve to rotate the sleeve as the control piston moves within the activation sub.

Embodiment 4. The method of any prior embodiment, further comprising flowing the fluid at one of: (i) below a flow rate activation threshold to perform a non-cutting operation; and (ii) above the flow rate activation threshold to perform a cutting operation.

Embodiment 5. The method of any prior embodiment, wherein the non-cutting operation includes at least one of: (i) cleaning a cement plug in the wellbore; (ii) cleaning an inner diameter surface of the casing; (iii) forming a perforation in the casing; and (iv) pulling the cutting tool through the wellbore.

Embodiment 6. The method of any prior embodiment, further comprising reducing the flow rate of the fluid to retract the cutter into the cutting tool.

Embodiment 7. The method of any prior embodiment, wherein the fluid flows through a second activation sub after flowing through the cutting tool, wherein a second flow rate activation threshold of the second activation sub is less than a flow rate activation threshold of the activation sub.

Embodiment 8. The method of any prior embodiment, further comprising flowing the fluid through a nozzle of the control piston.

Embodiment 9. The method of any prior embodiment, wherein the string further includes a pulling sub, further comprising anchoring the pulling sub in the casing and pulling the cutting tool through the wellbore to cut the casing using the pulling sub.

Embodiment 10. A wellbore system. The wellbore system includes a cutting tool having a ball seat coupled to a cutter and an activation sub coupled to the cutting tool. The activation sub includes a control piston movable therethrough, the control piston having a ball at an end thereof; wherein the control piston is configured to move within the activation sub to engage the ball to the ball seat when a flow rate of a fluid through the control piston is above a flow rate activation threshold, wherein engaging the ball to the ball seat creates a pressure differential across the ball seat that moves the ball seat to extend the cutter from the cutting tool.

Embodiment 11. The wellbore system of any prior embodiment, further comprising a control spring that biases the control piston in a first control position in which the ball is separated from the ball seat by a gap.

Embodiment 12. The method of any prior embodiment, further comprising a pump for controlling the flow rate of the fluid to move the control piston between the first position to a second position in which the ball is engaged to the seat.

Embodiment 13. The method of any prior embodiment, wherein the pump circulates the fluid at one of: (i) below the flow rate activation threshold to perform a non-cutting operation; and (ii) above the flow rate activation threshold to perform a cutting operation.

Embodiment 14. The method of any prior embodiment, further comprising a sleeve in the activation sub and a groove on an inner diameter wall of the sleeve, the control piston including a pin that engages to the groove to rotate the sleeve as the control piston moves within the activation sub.

Embodiment 15. The method of any prior embodiment, wherein a reduction of the flow rate of the fluid retracts the cutter into the cutting tool.

Embodiment 16. The method of any prior embodiment, wherein fluid flows through a second activation sub after flowing through the cutting tool, wherein a second flow rate activation threshold of the second activation sub is less than the flow rate activation threshold of the activation sub.

Embodiment 17. The method of any prior embodiment, wherein the control piston further comprises a nozzle for flow of the fluid through the control piston.

Embodiment 18. The method of any prior embodiment, wherein the cutting tool and the activation sub are disposed on a string disposed in the wellbore, the string further comprising at least one of: (i) a top sub; (ii) a bottom sub; (iii) a pulling sub; (iv) a perforation device; (v) a milling tool; and (vi) a cleaning tool.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method of cutting a casing in a wellbore, comprising:

disposing a string in the casing, the string including a cutting tool and an activation sub coupled to the cutting tool, the cutting tool including a ball seat and a cutter, the activation sub including a control piston disposed within a sleeve, the control piston having a ball at an end thereof;

flowing a fluid through the activation sub;

raising a flow rate of the fluid to move the control piston to engage the ball on the ball seat, wherein engaging the ball on the ball seat creates a pressure differential across the ball seat that moves the ball seat and wherein moving the control piston to engage the ball on the ball seat rotates the sleeve; and extending the cutter from the cutting tool via movement of the ball seat.

2. The method of claim 1, wherein the control piston is biased in a first control position in which the ball is separated from the ball seat by a gap, further comprising flowing the fluid through the control piston above a flow rate activation threshold to move the control piston from the first position to a second position in which the ball is engaged to the seat.

3. The method of claim 1, further comprising engaging a pin of the control piston to a groove of the sleeve to rotate the sleeve as the control piston moves within the activation sub.

4. The method of claim 3, further comprising flowing the fluid at one of: (i) below a flow rate activation threshold to perform a non-cutting operation; and (ii) above the flow rate activation threshold to perform a cutting operation.

5. The method of claim 4, wherein the non-cutting operation includes at least one of: (i) cleaning a cement plug in the wellbore; (ii) cleaning an inner diameter surface of the casing; (iii) forming a perforation in the casing; and (iv0 pulling the cutting tool through the wellbore.

6. The method of claim 1, further comprising reducing the flow rate of the fluid to retract the cutter into the cutting tool.

7. The method of claim 1, wherein the fluid flows through a second activation sub after flowing through the cutting tool, wherein a second flow rate activation threshold of the second activation sub is less than a flow rate activation threshold of the activation sub.

8. The method of claim 1, further comprising flowing the fluid through a nozzle of the control piston.

9. The method of claim 1, wherein the string further includes a pulling sub, further comprising anchoring the pulling sub in the casing and pulling the cutting tool through the wellbore to cut the casing using the pulling sub.

10. A wellbore system, comprising:

a cutting tool having a ball seat coupled to a cutter;

an activation sub coupled to the cutting tool, the activation sub comprising:

a sleeve: p2 a control piston disposed within the sleeve, the control piston having a ball at an end thereof; wherein the control piston is configured to move within the activation sub to engage the ball to the ball seat when a flow rate of a fluid through the control piston is above a flow rate activation threshold, wherein engaging the ball to the ball seat creates a pressure differential across the ball seat that moves the ball seat to extend the cutter from the cutting tool and the control piston rotates the sleeve while it moves to engage the ball on the ball seat.

11. The wellbore system of claim 10, further comprising a control spring that biases the control piston in a first control position in which the ball is separated from the ball seat by a gap.

12. The wellbore system of claim 11, further comprising a pump for controlling the flow rate of the fluid to move the control piston between the first position to a second position in which the ball is engaged to the seat.

13. The wellbore system of claim 10, further comprising a groove on an inner diameter wall of the sleeve, the control piston including a pin that engages to the groove to rotate the sleeve as the control piston moves within the activation sub.

14. The wellbore system of claim 10, wherein fluid flows through a second activation sub after flowing through the cutting tool, wherein a second flow rate activation threshold of the second activation sub is less than the flow rate activation threshold of the activation sub.

15. The wellbore system of claim 10, wherein the control piston further comprises a nozzle for flow of the fluid through the control piston.

16. The wellbore system of claim 10, wherein the cutting tool and the activation sub are disposed on a string disposed in the wellbore, the string further comprising at least one of: (i) a top sub; (ii) a bottom sub; (iii) a pulling sub; (iv) a perforation device; (v) a milling tool; and (vi) a cleaning tool.

* * * * *